US006538576B1

(12) United States Patent
Schultz et al.

(10) Patent No.: US 6,538,576 B1
(45) Date of Patent: Mar. 25, 2003

(54) SELF-CONTAINED DOWNHOLE SENSOR AND METHOD OF PLACING AND INTERROGATING SAME

(75) Inventors: Roger L. Schultz, Denton, TX (US); Benjamin B. Stewart, III, Aberdeen (GB); Jamie Oag, Aberdeen (GB); Nadir Mahjoub, Aberdeen (GB)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/298,725

(22) Filed: Apr. 23, 1999

(51) Int. Cl.[7] ..... G01V 3/00

(52) U.S. Cl. ..... 340/859.6; 324/329; 324/333; 166/250.01

(58) Field of Search ..... 340/854.6, 854.8, 340/856.2; 324/329, 333; 166/250.01

(56) References Cited

U.S. PATENT DOCUMENTS

| | | | | |
|---|---|---|---|---|
| 4,199,026 A | 4/1980 | McCollum | 166/251 | |
| 4,478,294 A | 10/1984 | Sumner | 175/4.56 | |
| 5,029,943 A | 7/1991 | Merriman | 299/1 | |
| 5,087,099 A | 2/1992 | Stolarczyk | 299/1 | |
| 5,121,971 A | 6/1992 | Stolarczyk | 299/1.6 | |
| 5,130,705 A | 7/1992 | Allen et al. | 340/853.9 | |
| 5,260,660 A | 11/1993 | Stolarczyk | 324/338 | |
| 5,268,683 A | 12/1993 | Stolarczyk | 340/854.4 | |
| 5,353,873 A | 10/1994 | Cooke, Jr. | 166/253 | |
| 5,363,094 A | 11/1994 | Staron et al. | 340/854.6 | |
| 5,455,573 A | 10/1995 | Delatorre | 340/854.8 | |
| 5,458,200 A | 10/1995 | Lagerlef et al. | 166/372 | |
| 5,662,165 A | 9/1997 | Tubel et al. | 166/250.01 | |
| 5,706,896 A | 1/1998 | Tubel et al. | 166/313 | |
| 5,721,538 A | 2/1998 | Tubel et al. | 340/853.4 | |
| 5,730,219 A | 3/1998 | Tubel et al. | 66/250.01 | |
| 5,732,773 A | 3/1998 | Parks et al. | 166/117.5 | |
| 5,767,680 A | 6/1998 | Torres-Verdin et al. | 324/355 | |
| 5,955,666 A * | 9/1999 | Mullins | 340/853.1 | |

FOREIGN PATENT DOCUMENTS

| | | | |
|---|---|---|---|
| EP | 0 882 871 A2 | 12/1998 | |
| GB | 2 323 443 A | 9/1998 | G01V/1/28 |
| GB | 2 352 042 A | 1/2001 | |
| WO | WO 98/09163 | 3/1998 | G01N/27/82 |
| WO | WO 98/57030 | 12/1998 | |
| WO | WO 99/02819 | 1/1999 | E21B/43/16 |
| WO | WO 99/66172 | 12/1999 | |
| WO | WO 00/73625 A | 12/2000 | |
| WO | WO 01/42622 A1 | 6/2001 | |

OTHER PUBLICATIONS

Penatrator and Dart NMR Probes, NASA Tech Briefs, May 1997.*

* cited by examiner

*Primary Examiner*—Michael Horabik
*Assistant Examiner*—Albert K. Wong
(74) *Attorney, Agent, or Firm*—Charles W. Gaines

(57) ABSTRACT

The present invention provides a self-contained sensor module for use in a subterranean well that has a well transmitter or a well receiver associated therewith. In one embodiment, the sensor module comprises a housing, a signal receiver, a parameter sensor, an electronic control assembly, and a parameter transmitter; the receiver, sensor, control assembly and transmitter are all contained within the housing. The housing has a size that allows the module to be positioned within a formation about the well or in an annulus between a casing positioned within the well and an outer diameter of the well. The signal receiver is configured to receive a signal from the well transmitter, while the parameter sensor is configured to sense a physical parameter of an environment surrounding the sensor module within the well. The electronic control assembly is coupled to both the signal receiver and the parameter sensor, and is configured to convert the physical parameter to a data signal. The parameter transmitter is coupled to the electronic control assembly and is configured to transmit the data signal to the well receiver.

28 Claims, 4 Drawing Sheets

SELF-CONTAINED DOWNHOLE SENSOR AND METHOD OF PLACING AND INTERROGATING SAME

TECHNICAL FIELD OF THE INVENTION

The present invention is directed, in general, to subterranean exploration and production and, more specifically, to a system and method for placing multiple sensors in a subterranean well and obtaining subterranean parameters from the sensors.

BACKGROUND OF THE INVENTION

The oil industry today relies on many technologies in its quest for the location of new reserves and to optimize oil and gas production from individual wells. Perhaps the most general of these technologies is a knowledge of the geology of a region of interest. The geologist uses a collection of tools to estimate whether a region may have the potential for holding subterranean accumulations of hydrocarbons. Many of these tools are employed at the surface to predict what situations may be present in the subsurface. The more detailed knowledge of the formation that is available to the geophysicist, the better decisions that can be made regarding production.

Preliminary geologic information about the subterranean structure of a potential well site may be obtained through seismic prospecting. An acoustic energy source is applied at the surface above a region to be explored. As the energy wavefront propagates downward, it is partially reflected by each subterranean layer and collected by a surface sensor array, thereby producing a time dependent recording. This recording is then analyzed to develop an estimation of the subsurface situation. A geophysicist then studies these geophysical maps to identify significant events that may determine viable prospecting areas for drilling a well.

Once a well has been sunk, more information about the well can be obtained through examination of the drill bit cuttings returned to the surface (mud logging) and the use of open hole logging techniques, for example: resistivity logging and parameter logging. These methods measure the geologic formation characteristics pertaining to the possible presence of profitable, producible formation fluids before the well bore is cased. However, the reliability of the data obtained from these methods may be impacted by mud filtration. Additionally, formation core samples may be obtained that allow further, more direct verification of hydrocarbon presence.

Once the well is cased and in production, well production parameters afford additional data that define the possible yield of the reservoir. Successful delineation of the reservoir may lead to the drilling of additional wells to successfully produce as much of the in situ hydrocarbon as possible. Additionally, the production of individual zones of a multi-zone well may be adjusted for maximum over-all production.

Properly managing the production of a given well is important in obtaining optimum long-term production. Although a given well may be capable of a greater initial flow rate, that same higher initial production may be counter to the goal of maximum overall production. High flow rates may cause structural changes to the producing formation that prevents recovering the maximum amount of resident hydrocarbon. In order to optimize production of a given well, it is highly desirable to know as much as possible about the well, the production zones, and surrounding strata in terms of temperature, pressure, flow rate, etc. However, direct readings are available only within the confines of the well and produce a two-dimensional view of the formation.

As hydrocarbons are depleted from the reservoir, reductions in the subsurface pressures typically occur causing hydrocarbon production to decline. Other, less desirable effects may also occur. On-going knowledge of the well parameters during production significantly aids in management of the well. At this stage of development, well workover, as well as secondary and even tertiary recovery methods, may be employed in an attempt to recover more of the hydrocarbon than can be produced otherwise. The success of these methods may only be determined by production increases. However, if the additional recovery methods either fail or meet with only marginal success, the true nature of the subsurface situation may typically only be postulated. The inability to effectively and efficiently measure parameters in existing wells and reservoirs that will allow the determination of a subterranean environment may lead to the abandonment of a well, or even a reservoir, prematurely.

One approach to obtaining ongoing well parameters in the well bore has been to connect a series of sensors to an umbilical, to attach the sensors and umbilical to the exterior of the well casing, and to lower the well casing and sensors into the well. Unfortunately, in the rough environment of oil field operation, it is highly likely that the sensors or the umbilical may be damaged during installation, thus jeopardizing data acquisition.

Accordingly, what is needed in the art is a multi-parameter sensing system that: (a) overcomes the damage-prone shortcomings of the umbilical system, (b) may be readily placed in a well bore, as deep into the geologic formation as possible, (c) can provide a quasi three-dimensional picture of the well, and (d) can be interrogated upon command.

SUMMARY OF THE INVENTION

To address the above-discussed deficiencies of the prior art, the present invention provides a self-contained sensor module for s use in a subterranean well that has a well transmitter or a well receiver associated therewith. In one embodiment, the sensor module comprises a housing, a signal receiver, a parameter sensor, an electronic control assembly, and a parameter transmitter. The receiver, sensor, control assembly and transmitter are all contained within the housing. The housing has a size that allows the module to be positioned within a formation about the well or in an annulus between a casing positioned within the well and an outer diameter of the well. The signal receiver is configured to receive a signal from the well transmitter, while the parameter sensor is configured to sense a physical parameter of an environment surrounding the sensor module within the well. The electronic control assembly is coupled to both the signal receiver and the parameter sensor, and is configured to convert the physical parameter to a data signal. The parameter transmitter is coupled to the electronic control assembly and is configured to transmit the data signal to the well receiver.

In an alternative embodiment, the sensor module further includes an energy storage device coupled to the signal receiver and the electronic control assembly. The energy storage device may be various types of power sources, such as a battery, a capacitor, or a nuclear fuel cell. In another embodiment, the sensor module also includes an energy converter that is coupled to the signal receiver. The energy converter converts the signal to electrical energy for storage in the energy storage device. In yet another embodiment, the signal receiver may be an acoustic vibration sensor, a piezoelectric element or a triaxial voice coil.

In a preferred embodiment, the sensor module has a size that is less than an inner diameter of an annular bottom plug in the casing. In this embodiment, there is an axial aperture through the annular bottom plug and a rupturable membrane disposed across the axial aperture.

In another embodiment, the signal receiver and the parameter transmitter are a transceiver. The physical parameter to be measured may be: temperature, pressure, acceleration, resistivity, porosity, or flow rate. In advantageous embodiments, the signal may be electromagnetic, seismic, or acoustic in nature. The housing may also be a variety of shapes, such as prolate, spherical, or oblate spherical. The housing, in one embodiment, may be constructed of a semicompliant material.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
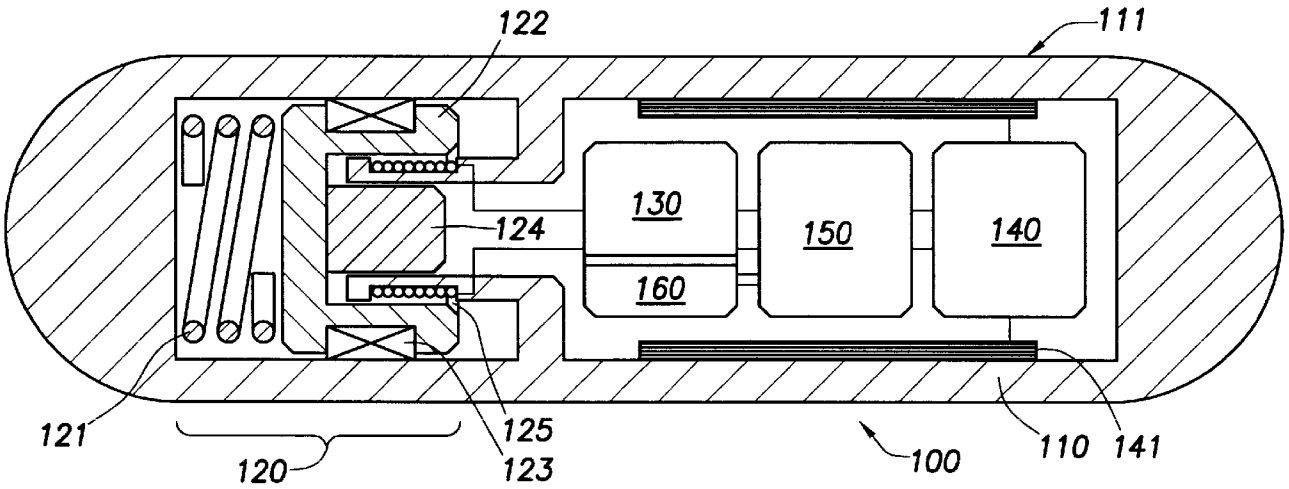
FIG. 1 illustrates a sectional view of one embodiment of a self-container sensor module for use in a subterranean well.

Referring initially to FIG. 1, illustrated is a sectional view of one embodiment of a self-contained sensor module for use in s a subterranean well. A self-contained sensor module 100 comprises a housing 110, and a signal receiver 120, an energy storage device 130, a parameter sensor 140, an electronic control assembly 150, and a parameter transmitter 160 contained within the housing 110. In an alternative embodiment, the signal receiver 120 and parameter transmitter 160 may be a transceiver. The housing 110 may be constructed of any suitable material, e.g., aluminum, steel, etc., that can withstand the rigors of its environment; however in a particular embodiment, the housing may be, at least partly, of a semicompliant material, such as a resilient plastic. The housing 110 preferably has a size that enables the module 100 to be positioned in a producing formation or in an annulus between a well casing and a well bore to be described below. While the shape of the housing 110 illustrated may be prolate, other embodiments of spherical or oblate spherical shapes are also well suited to placing the housing 110 in a desired location within a subterranean well. However, any shape that will accommodate necessary system electronics and facilitate placing the module 100 where desired in the well may be used as well.

In the illustrated embodiment, the signal receiver 120 is an acoustic vibration sensor that may also be termed an energy converter. In a preferred embodiment, the acoustic vibration sensor 120 comprises a spring 121, a floating bushing 122, bearings 123, a permanent magnet 124, and electrical coils 125. Under the influence of an acoustic signal, which is discussed below, the floating bushing 122 and permanent magnet 124 vibrate setting up a current in electrical coils 125. The current generated is routed to the energy storage device 130, which may be a battery or a capacitor. In an alternative embodiment, the energy storage device 130 may be a nuclear fuel cell that does not require charging from the signal receiver 120. In this embodiment, the signal receiver 120 may be coupled directly to the electronic control assembly 150. However, in a preferred embodiment, the energy storage device 130 is a battery. The electronic control assembly 150 is electrically coupled between the energy storage device 130 and the parameter sensor 140. The parameter sensor 140 is configured to sense one or more of the following physical parameters: temperature, pressure, acceleration, resistivity, porosity, chemical properties, cement strain, and flow rate. In the illustrated embodiment, a strain gauge 141, or other sensor, is coupled to the parameter sensor 140 in order to sense pressure exerted on the compliant casing 110. Of course other methods of collecting pressure, such as piezoelectric elements, etc., may also by used. One who is skilled in the art is familiar with the nature of the various sensors that may be used to collect the other listed parameters. While the illustrated embodiment shows sensors 141 located entirely within the housing 110, sensors may also by mounted on or extend to an exterior surface 111 of the housing while remaining within the broadest scope of the present invention.

Figure 2:
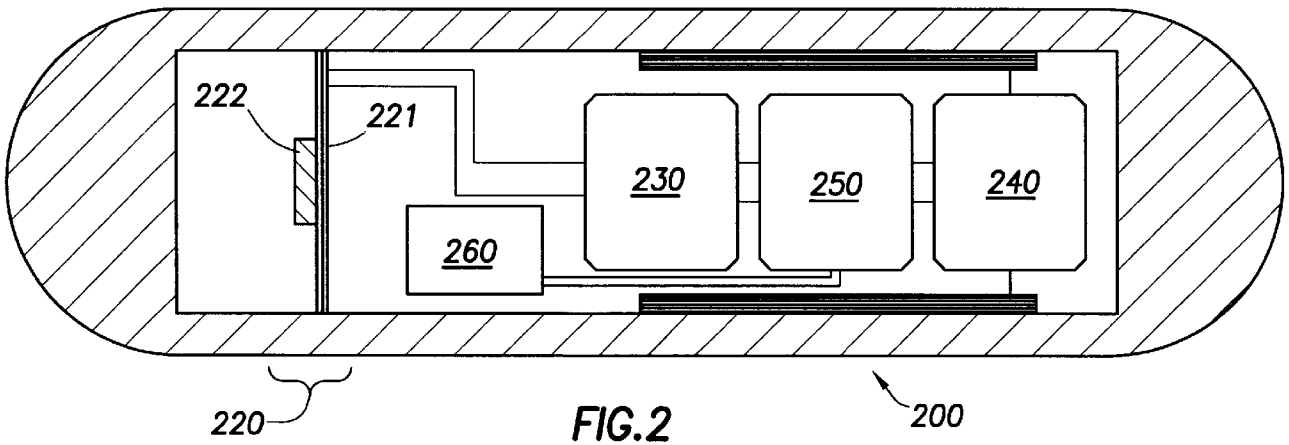
FIG. 2 illustrates a sectional view of an alternative embodiment of the self-container sensor module of FIG. 1.

Referring now to FIG. 2, illustrated is a sectional view of an alternative embodiment of the self-contained sensor module of FIG. 1. In the illustrated embodiment, a signal receiver 220 of a self-contained sensor module 200 is a piezoelectric element 221 and a mass 222. In a manner analogous to the acoustic vibration sensor 120 of FIG. 1, the mass 222 and piezoelectric element 221 displace as the result of an acoustic signal, setting up a current in the piezoelectric element 221 that is routed to the energy storage device 130. Self-contained sensor module 200 further comprises an energy storage device 230, a parameter sensor 240, an electronic control assembly 250, and a parameter transmitter 260 that are analogous to their counterparts of FIG. 1 and are well known individual electronic components.

Figure 3:
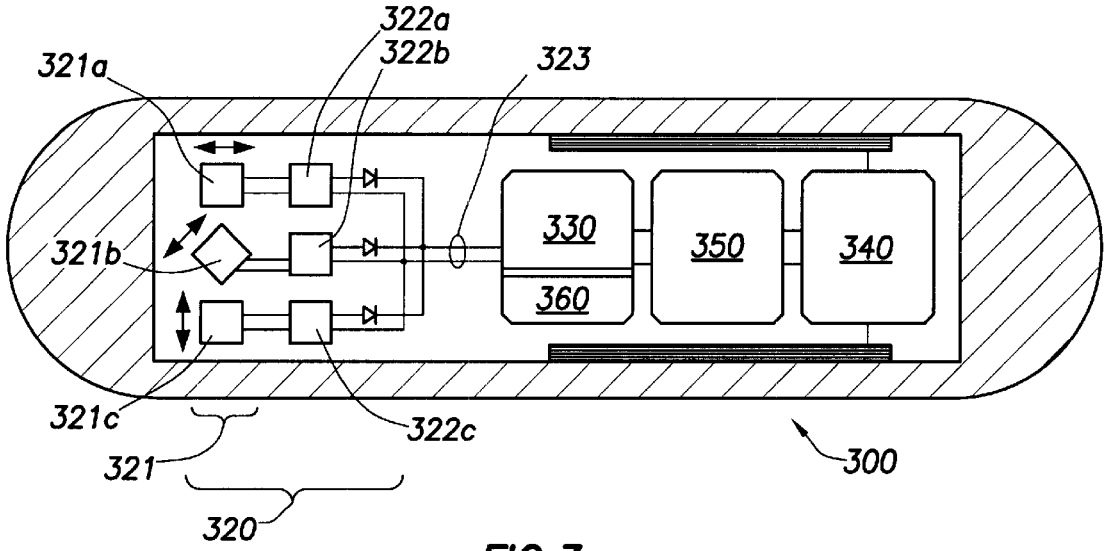
FIG. 3 illustrates a sectional view of another embodiments of the self-contained sensor module of FIG. 1.

Referring now to FIG. 3, illustrated is a sectional view of another embodiment of the self-contained sensor module of FIG. 1. In the illustrated embodiment, a signal receiver 320 of a self-contained sensor module 300 is a triaxial voice coil 321 consisting of voice coils 321*a*, 321*b*, and 321*c*. In response to an acoustic vibration, signals generated within the voice coils 321*a*, 321*b*, and 321*c* are routed through ac to dc converters 322*a*, 322*b*, 322*c* and summed for an output 323 to an energy storage device 330 or, alternatively, directly to an electronic control assembly 350. The functions of parameter sensor 340, electronic control assembly 350, and parameter transmitter 360 are analogous to their counterparts of FIG. 1.

Figure 4A:
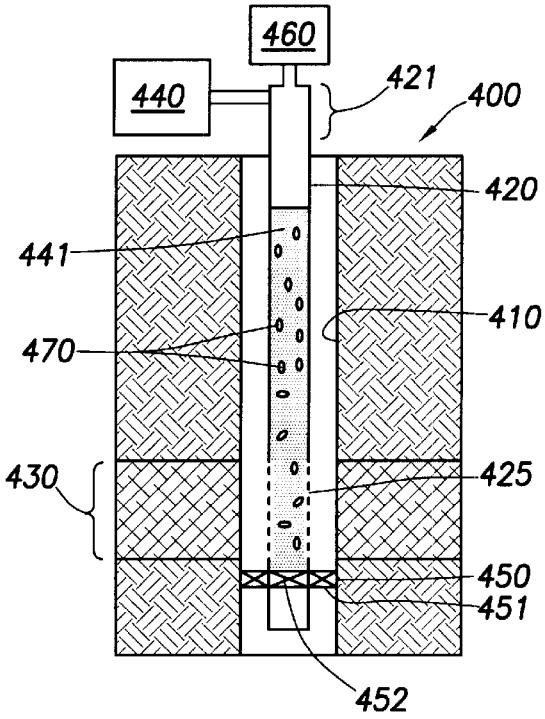
FIG. 4A illustrates a sectional view of one embodiment of a subterranean well employing the self-contained sensor module of FIG. 1.

Referring now to FIG. 4A, illustrated is a sectional view of one embodiment of a subterranean well employing the self-contained sensor module of FIG. 1. A subterranean well 400 comprises a well bore 410, a casing 420 having perforations 425 formed therein, a production zone 430, a conventional hydraulic system 440, a conventional packer system 450, a module dispenser 460, and a plurality of self-contained sensor modules 470. In the illustrated embodiment, the well 400 has been packed off with the packer system 450 comprising a well packer 451 between the casing 420 and the well bore 410, and a casing packer 452 within the casing 420. Hydraulic system 440, at least temporarily coupled to a surface location 421 of the well casing 420, pumps a fluid 441, typically a drilling fluid, into the casing 420 as the module dispenser 460 distributes the plurality of self-contained sensor modules 470 into the fluid 441.

Figure 4B:
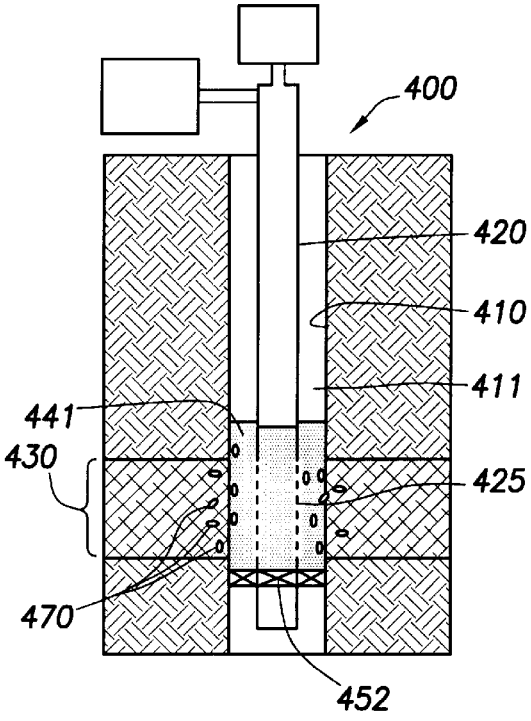
FIG. 4B illustrates a sectional view of the subterranean well of FIG. 4A with a plurality of the self-contained sensor modules of FIG. 1 placed in the formation.

Referring now to FIG. 4B, illustrated is a sectional view of the subterranean well of FIG. 4A with a plurality of the self-contained sensor modules of FIG. 1 placed in the formation. The fluid 441 is prevented from passing beyond casing packer 452; therefore, the fluid 441 is routed under pressure through perforations 425 into a well annulus 411 between the well casing 420 and the well bore 410. The module 470 is of such a size that it may pass through the perforations with the fluid 441 and, thereby enable at least some of the plurality of self-contained sensor modules 470 to be positioned in the producing formation 430. The prolate, spherical, or oblate spherical shape of the modules 470 facilitates placement of the modules in the formation 430.

Figure 5B:
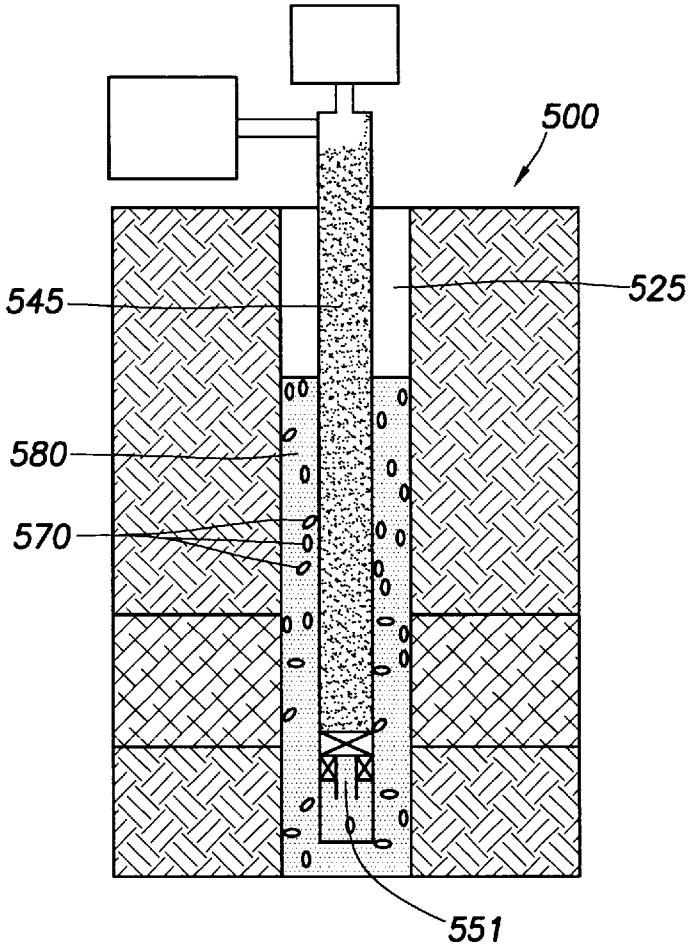
FIG. 5B illustrates a sectional view of the subterranean well of FIG. 5A with the plurality of self-contained sensor modules of FIG. 1 placed in the well annulus.
Figure 5A:
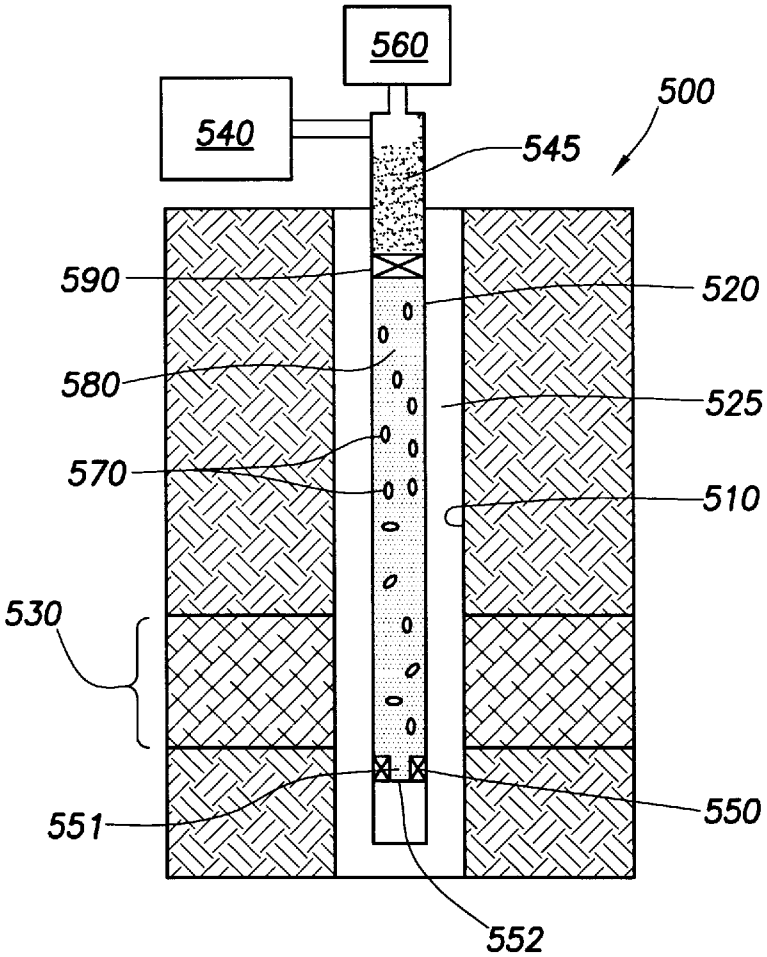
FIG. 5A illustrates a sectional view of an alternative embodiment of a subterranean well employing the self-contained sensor module of FIG. 1.

Referring now to FIG. 5A, illustrated is a sectional view of an alternative embodiment of a subterranean well employing the self-contained sensor module of FIG. 1. A subterranean well 500 comprises a well bore 510, a casing 520, a well annulus 525, a production zone 530, a hydraulic system 540, an annular bottom plug 550, a module dispenser 560, a plurality of self-contained sensor modules 570, a cement slurry 580, and a top plug 590. In the illustrated embodiment, the annular bottom plug 550 has an axial aperture 551 therethrough and a rupturable membrane 552 across the axial aperture 551. After the annular bottom plug 550 has been installed in the casing 520, a volume of cement slurry 580 sufficient to fill at least a portion of the well annulus 525 is pumped into the well casing 520. One who is skilled in the art is familiar with the use of cement to fill a well annulus. While the cement slurry 580 is being pumped into the casing 520, the module dispenser 560 distributes the plurality of self-contained sensor modules 570 into the cement slurry 580. When the desired volume of cement slurry 580 and number of sensor modules 570 have been pumped into the well casing 520, the top plug 590 is installed in the casing 520. Under pressure from the hydraulic system 540, a drilling fluid 545 forces the top plug 590 downward and the cement slurry 580 ruptures the rupturable membrane 552.

Referring now to FIG. 5B, illustrated is a sectional view of the subterranean well of FIG. 5A with the plurality of self-contained sensor modules of FIG. 1 placed in the well annulus. The cement slurry 580 and modules 570 flow under pressure into the well annulus 525. The size of the modules 570 is such that the modules 570 may pass through the axial aperture 551 with the cement slurry 580 and enable at least some of the plurality of self-contained sensor modules 570 to be positioned in the well annulus 525. The prolate, spherical, or oblate spherical shape of the module 570 facilitates placement of the module in the well annulus 525. One who is skilled in the art is familiar with the use of cement slurry to fill a well annulus.

Figure 6:
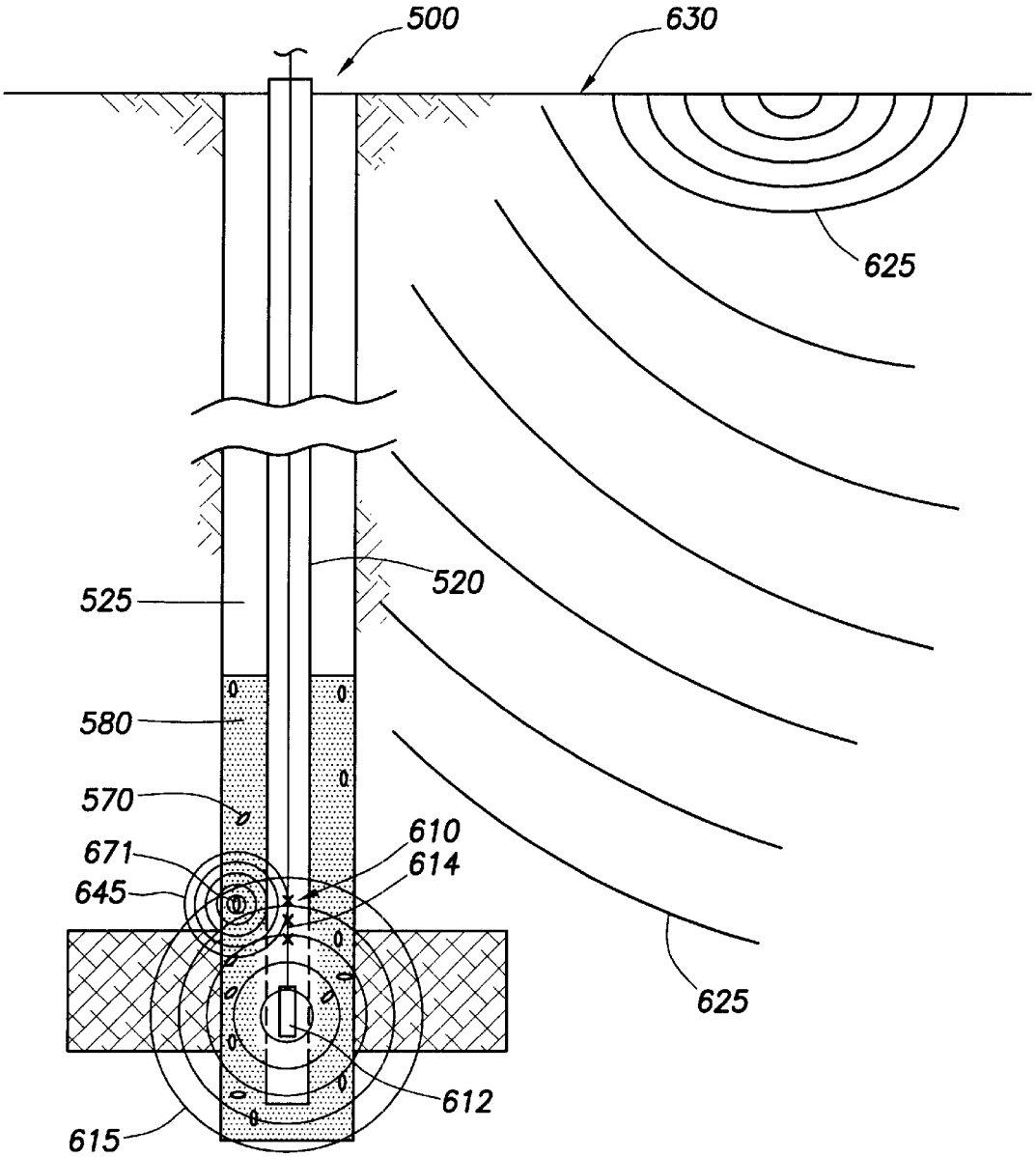
FIG. 6 illustrates a sectional view of a portion of the subterranean well of FIG. 5 with a plurality of self-contained sensor modules distributed in the well annulus.

Referring now simultaneously to FIG. 6 and FIG. 1, FIG. 6 illustrates a sectional view of a portion of the subterranean well of FIG. 5 with a plurality of self-contained sensor modules 570 distributed in the well annulus 525. For the purpose of this discussion, the sensor module 100 of FIG. 1 and the sensor modules 570 of FIG. 5 are identical. One who is skilled in he art will readily recognize that the other embodiments of FIGS. 2 and 3 may readily be substituted for the sensor module of FIG. 1. When the sensor modules 570 are distributed into the cement slurry 580 and pumped into the well annulus 525, the sensor modules 570 are positioned in a random orientation as shown. In the illustrated embodiment, a wireline tool 610 has been inserted into the well casing 520 and proximate sensor modules 570. The wireline tool 610 comprises a well transmitter 612 that creates a signal 615 configured to be received by the signal receiver 120. The signal 615 may be electromagnetic, radio frequency, or acoustic. Alternatively, a seismic signal 625 may be created at a surface 630 near the well 500 so as to excite the signal receiver 120. One who is skilled in the art is familiar with the creation of seismic waves in subterranean well exploration.

For the purposes of clarity, a single sensor module 671 is shown reacting to the signal 615 while it is understood that other modules would also receive the signal 615. Of course, one who is skilled in the art will understand that the signal 615 may be tuned in a variety of ways to interrogate a particular type of sensor, e.g., pressure, temperature, etc., or only those sensors within a specific location of the well by controlling various parameters of the signal 615 and functionality of the sensor module 570, or multiple sensors can be interrogated at once. Under the influence of the acoustic signal 615 or seismic signal 625, the floating bushing 122 and permanent magnet 124 vibrate, setting up a current in coils 125. The generated current is routed to the energy storage device 130 that powers the electronic control assembly 150, the parameter sensor 140, and the parameter transmitter 160. In one embodiment, the electronic control assembly 150 may be directed by signals 615 or 625 to collect and transmit one or more of the physical parameters previously enumerated. The physical parameters sensed by the parameter sensor 140 are converted by the electronic control assembly 150 into a data signal 645 that is transmitted by the parameter transmitter 160. The data signal 645 may be collected by a well receiver 614 and processed by a variety of means well understood by one who is skilled in the art. It should also be recognized that the well receiver 614 need not be collocated with the well transmitter 612. The illustrated embodiment is of one having sensor modules 570 deployed in the cement slurry 580 of a subterranean well 500. Of course, the principles of operation of the sensor modules 570 are also readily applicable to the well 400 of FIG. 4 wherein the modules 470 are located in the production formation 430. It should be clear to one who is skilled in the art that modules 100, 200, 300, 470, and 570 are interchangeable in application to well configurations 400 or 500, or various combinations thereof.

Therefore, a self-contained sensor module 100 has been described that permits placement in a producing formation or in a well annulus. A plurality of the sensor modules 100 may be interrogated by a signal from a transmitter on a wireline or other common well tool, or by seismic energy, to collect parameter data associated with the location of the sensor modules 100. The modules may be readily located in the well annulus or a producing formation. Local physical parameters may be measured and the parameters transmitted to a collection system for analysis. As the sensor modules 100 may be located within the well bore at varying elevations and azimuths from the well axis, an approximation to a 360 degree or three dimensional model of the well may be obtained. Because the sensor modules are self-contained, they are not subject to the physical limitations associated with the conventional umbilical systems discussed above. In one embodiment, the interrogation signal may be used to transmit energy that the module can convert and store electrically. The electrical energy may then be used to power the electronic control assembly, parameter sensor, and parameter transmitter.

Although the present invention has been described in detail, those skilled in the art should understand that they can make various changes, substitutions and alterations herein without departing from the spirit and scope of the invention in its broadest form.

What is claimed is:

1. For use in a subterranean well bore having a well transmitter or a well receiver associated therewith, a self-contained sensor module, comprising:

a housing having a size that allows said module to be positioned within a formation about said well or between a casing positioned within said well and an outer diameter of said well bore;

a signal receiver contained within said housing and configured to receive a signal from said well transmitter;

a parameter sensor contained within said housing and configured to sense a physical parameter of an environment surrounding said sensor module within said well;

an electronic control assembly contained within said housing, said electronic control assembly coupled to said signal receiver and said parameter sensor and configured to convert said physical parameter to a data signal; and a parameter transmitter contained within said housing, said parameter transmitter coupled to said electronic control assembly and configured to transmit said data signal to said well receiver.

2. The sensor module as recited in claim 1 further comprising an energy storage device coupled to said signal receiver and said electronic control assembly, said energy storage device selected from the group consisting of:

a battery, a capacitor, and a nuclear fuel cell.

3. The sensor module as recited in claim 2 further comprising an energy converter coupled to said signal receiver, said energy converter configured to convert said signal to electrical energy for storage in said energy storage device.

4. The sensor module as recited in claim 3 wherein said signal receiver is selected from the group consisting of:

an acoustic vibration sensor;

a piezoelectric element; and a triaxial voice coil.

5. The sensor module as recited in claim 1 wherein said size is less than an inner diameter of an annular bottom plug of said casing, said annular bottom plug having an axial aperture therethrough and a rupturable membrane disposed across said axial aperture.

6. The sensor module as recited in claim 1 wherein said signal receiver and said parameter transmitter are a transceiver.

7. The sensor module as recited in claim 1 wherein said physical parameter is selected from the group consisting of:

temperature;

pressure;

acceleration;

resistivity;

porosity;

gamma radiation;

magnetic field; and flow rate.

8. The sensor module as recited in claim 1 wherein said signal is selected from the group consisting of:

electromagnetic;

radio frequency;

seismic; and acoustic.

9. The sensor module as recited in claim 1 wherein a shape of said housing is selected from the group consisting of:

prolate;

spherical; and oblate spherical.

10. The sensor module as recited in claim 1 wherein said housing is constructed of a semicompliant material.

11. A subterranean well, comprising:

a well bore having a casing therein, said casing creating a well annulus between an outer surface of said casing and an inner surface of said well bore;

a production zone about said well; and a plurality of self-contained sensor modules wherein said self-contained sensor modules are positioned within said well annulus or said production zone, said self-contained sensor modules including:

a housing having a size that allows said module to be positioned within a formation about said subterranean well or between a casing positioned within said subterranean well and an outer diameter of said well bore;

a signal receiver contained within said housing and configured to receive a signal from said well transmitter;

a parameter sensor contained within said housing and configured to sense a physical parameter of an environment surrounding said sensor module within said subterranean well;

an electronic control assembly contained within said housing, said electronic control assembly coupled to said signal receiver and said parameter sensor and configured to convert said physical parameter to a data signal; and a parameter transmitter contained within said housing, said parameter transmitter coupled to said electronic control assembly and configured to transmit said data signal to a receiver associated with said well.

12. The subterranean well as recited in claim 11 wherein said self-contained sensor module further comprises an energy storage device coupled to said signal receiver and said electronic control assembly, said energy storage device selected from the group consisting of:

a battery, a capacitor, and a nuclear fuel cell.

13. The subterranean well as recited in claim 12 wherein said self-contained sensor module further comprises an energy converter coupled to said signal receiver, said energy converter configured to convert said signal to electrical energy for storage in said energy storage device.

14. The subterranean well as recited in claim 11 wherein said signal receiver is selected from the group consisting of:

an acoustic vibration sensor;

a piezoelectric element; and a triaxial voice coil.

15. The subterranean well as recited in claim 11 wherein said size is less than an inner diameter of an annular bottom plug of said casing, said annular bottom plug having an axial aperture therethrough and a rupturable membrane disposed across said axial aperture.

16. The subterranean well as recited in claim 11 wherein said signal receiver and said parameter transmitter are a transceiver.

17. The subterranean well as recited in claim 11 wherein said physical parameter is selected from the group consisting of:

temperature;

pressure;

acceleration;

resistivity;

porosity;

gamma radiation;

magnetic field; and flow rate.

18. The subterranean well as recited in claim 11 wherein said signal is selected from the group consisting of:

electromagnetic;

seismic; and acoustic.

19. The subterranean well as recited in claim 11 wherein a shape of said housing is selected from the group consisting of:

prolate;

spherical; and oblate spherical.

20. The subterranean well as recited in claim 11 wherein said housing is constructed of a semicompliant material.

21. The subterranean well as recited in claim 11 wherein at least some of said plurality of self-contained sensor modules are distributed throughout said well annulus.

22. The subterranean well as recited in claim 11 wherein at least some of said plurality of self-contained sensor modules are embedded in said production zone.

23. A method of operating a sensor system disposed within a subterranean well, comprising:

positioning a self-contained sensor module into said subterranean well, said self-contained sensor module including:

a housing having a size that allows said module to be positioned between a casing within said subterranean well and an outer diameter of said subterranean well;

a signal receiver contained within said housing and configured to receive a signal from a well transmitter;

a parameter sensor contained within said housing and configured to sense a physical parameter of an environment surrounding said sensor module within said subterranean well;

an electronic control assembly contained within said housing, said electronic control assembly coupled to said signal receiver and said parameter sensor and configured to convert said physical parameter to a data signal; and a parameter transmitter contained within said housing, said parameter transmitter coupled to said electronic control assembly and configured to transmit said data signal to a receiver associated with said well;

exciting said signal receiver,;

sensing a physical parameter of an environment surrounding said sensor module;

converting said physical parameter to a data signal; and transmitting said data signal to a receiver associated with said well.

24. The method as recited in claim 23 wherein positioning includes positioning said modules in a production formation.

25. The method as recited in claim 23 wherein positioning includes positioning said modules in an annulus between said casing and said outer diameter of said subterranean well.

26. The method as recited in claim 23 wherein exciting includes exciting with a transmitter on a wireline tool.

27. The method as recited in claim 23 wherein exciting includes exciting with a seismic wave.

28. The method as recited in claim 23 wherein exciting includes interrogating said module to cause said parameter transmitter to transmit said data signal.

* * * * *